US011820151B2

(12) United States Patent
Takagi et al.

(10) Patent No.: US 11,820,151 B2
(45) Date of Patent: Nov. 21, 2023

(54) IMAGE RECORDING APPARATUS

(71) Applicant: CANON KABUSHIKI KAISHA, Tokyo (JP)

(72) Inventors: Yosuke Takagi, Kanagawa (JP); Chiaki Muraoka, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 17/675,893

(22) Filed: Feb. 18, 2022

(65) Prior Publication Data

US 2022/0266598 A1 Aug. 25, 2022

(30) Foreign Application Priority Data

Feb. 24, 2021 (JP) ..... 2021-027693

(51) Int. Cl.
*B41J 2/175* (2006.01)

(52) U.S. Cl.
CPC ..... *B41J 2/17566* (2013.01); *B41J 2/17509* (2013.01); *B41J 2/17513* (2013.01); *B41J 2/17553* (2013.01); *B41J 2002/17579* (2013.01)

(58) Field of Classification Search
CPC ..... B41J 2/17503; B41J 2/17506; B41J 2/17509; B41J 2/17513; B41J 2/17553; B41J 2/17566; B41J 2002/17579
See application file for complete search history.

(56) References Cited

U.S. PATENT DOCUMENTS 4,636,814 A * 1/1987 Terasawa ..... B41J 2/17566 347/7
5,051,759 A * 9/1991 Karita ..... B41J 2/17566 347/7
5,289,211 A * 2/1994 Morandotti ..... B41J 2/17566 73/304 R
7,306,308 B2 * 12/2007 Tsukada ..... B41J 2/17566 347/7
9,789,697 B1 * 10/2017 Knierim ..... B41J 2/17513

FOREIGN PATENT DOCUMENTS

JP 2015223830 A 12/2015

* cited by examiner

*Primary Examiner* — Anh T Vo
(74) *Attorney, Agent, or Firm* — Canon U.S.A., Inc. I.P. Division

(57) ABSTRACT

An image recording apparatus includes: a liquid ejection cartridge unit that ejects ink droplets and includes a liquid chamber that stores liquid, and a first and a second electrode pins inserted in the liquid chamber; an application portion that applies a voltage between the first and the second electrode pins; and a detection portion that includes a detection resistance to which a voltage is applied by the application portion and detects a voltage value or a current value. When the application portion applies a voltage, the detection portion detects the voltage value or the current value so that the amount of liquid remaining in the liquid chamber is detected. At least one of the determination threshold value of the amount of the liquid in the liquid chamber, the applied voltage value, or the detection resistance value is set at intervals based on the cumulative application time of the voltage.

12 Claims, 11 Drawing Sheets

IMAGE RECORDING APPARATUS

BACKGROUND OF THE DISCLOSURE

Field of the Disclosure

The present disclosure relates to an image recording apparatus that records images by ejecting a liquid such as ink onto recording media.

Description of the Related Art

Conventionally, various recording methods have been proposed that use liquid ejection cartridge units as a means for recording images on recording media such as paper. Examples of such methods include a thermal transfer method, a wire dot method, a heat-sensitive method, and an inkjet method, which are in actual use. Among them, the inkjet method has attracted attention as a recording method that has a low running cost and reduced recording sound, and is used in a wide range of fields.

The inkjet method drives the recording element substrate of the liquid ejection cartridge unit to eject ink droplets onto the surface of the recording element substrate from an ink ejection port formed by a nozzle member. This image recording method forms an image by placing ink droplets at desired positions on a media surface.

With a typical inkjet method, a signal or power supply for driving the recording element substrate is supplied to the liquid ejection cartridge unit from the image recording apparatus in which the liquid ejection cartridge unit is installed via an electrical connection portion.

Various configurations are used to supply the liquid ejection cartridge unit with a liquid such as ink used to form images. In one typical configuration, an ink tank, which is separate from the liquid ejection cartridge unit and has a liquid storage chamber, is directly connected to the liquid ejection cartridge unit to supply the liquid in the ink tank to the liquid ejection cartridge unit. A tube supply method, which is also commercially available, supplies liquid from an ink tank set in the image recording apparatus to the liquid ejection cartridge via an ink supply tube. With the tube supply method, the liquid ejection cartridge unit generally has sub tanks, which temporarily hold the liquid supplied from the ink supply tube, and the liquid is then supplied to the recording element substrate.

In any of the above methods, the liquid supplied from the liquid supply source is guided into the liquid ejection cartridge and then guided to the recording element substrate through a liquid supply flow path formed in the housing of the liquid ejection cartridge unit.

The image recording apparatus needs to have a function of determining the amount of liquid remaining in the supply source. This function is needed for two main purposes. The first purpose is to indicate to the user when the amount of liquid remaining in the supply source is low to prompt the user to replace the ink tank or fill the tank with liquid. The second purpose is to trigger printing control, such as division printing, in order to avoid the breaking of a nozzle member, which may occur when the ejection action is performed in the absence of liquid.

Various methods have been proposed to detect the amount of remaining liquid. Examples of proposed methods include a dot count method, which calculates the amount of remaining liquid from the number of liquid ejections, a prism method, which determines the amount by irradiating the liquid storage chamber with light and obtaining the reflected light level with a sensor, and a pin remaining-amount detection method, which inserts electrode pins into the liquid storage chamber to obtain an electric response. Of the above, the pin remaining-amount detection method has been widely implemented because the method requires a relatively low cost to introduce and has high detection accuracy.

A common pin remaining-amount detection method that has been conventionally used applies an electric signal to two electrode pins inserted in the liquid storage chamber to detect the amount of remaining liquid. The liquid, such as ink, typically conducts electricity. As such, when the liquid storage chamber contains liquid (when the two electrode pins are in contact with the liquid), an electric signal applied to an electrode pin causes a current to flow between the electrode pins via the liquid. In contrast, when there is no liquid (the two electrode pins are not in contact with ink), a current does not flow because of the absence of an electric path between the electrode pins.

Based on such characteristics, a configuration has been adopted that applies an electric signal between electrode pins and obtains an electric response to determine the presence or absence of ink (Japanese Patent Application Publication No. 2015-223830).

However, the configuration disclosed in Japanese Patent Application Publication No. 2015-223830 may cause the following problem.

The electrode pins are generally made of a metal material such as stainless steel. When a current is repeatedly passed in one direction between two electrode pins, one serving as the anode and the other serving as the cathode, with liquid present between the electrode pins, a metal oxidation/reduction reaction may occur on the surface of the electrode pins. That is, oxidation takes place on the surface of the anode electrode pin, while reduction takes place on the surface of the cathode electrode pin. As the above reaction proceeds, the oxidation of the anode electrode pin increases the electrical resistance. This reduces the value of current between the electrode pins even though the liquid is present. In this case, the difference between response in the presence of liquid and response in the absence of liquid becomes small, lowering the accuracy in detecting the amount of remaining liquid.

The reduced accuracy in detecting the amount of remaining liquid may result in the user being prompted to replace the ink tank even though liquid is present, or that the division printing mode is set, reducing the printing speed. In another case, even though liquid is absent, empty-ejection printing (printing action without liquid ejection) is performed without the absence being indicated. This can break the nozzle member. As described above, a decrease in the accuracy of remaining liquid amount detection is undesirable in terms of usability and reliability.

SUMMARY OF THE DISCLOSURE

Aspects of the present disclosure provide a technique that improves the accuracy in detecting the amount of remaining liquid.

An image recording apparatus of the present disclosure includes:

- a liquid ejection cartridge unit that ejects ink droplets from a recording element substrate to form an image on a recording material, the liquid ejection cartridge unit including:
  - a liquid chamber that stores liquid to be used to record an image; and a first electrode pin and a second electrode pin inserted in the liquid chamber;

an application portion that applies a voltage between the first electrode pin and the second electrode pin; and a detection portion that includes a detection resistance to which a voltage is applied by the application portion, and detects a voltage value or a current value between the first electrode pin and the second electrode pin, wherein in a case the application portion applies a voltage between the first electrode pin and the second electrode pin, the detection portion detects the voltage value or the current value so that a detection action that detects an amount of the liquid remaining in the liquid chamber is performed, and at least one of a determination threshold value for determining whether the amount of the liquid in the liquid chamber is less than a predetermined amount, an applied voltage value applied by the application portion, or a detection resistance value of the detection resistance is set at intervals based on a cumulative application time of the voltage.

According to the present disclosure, the accuracy in detecting the amount of remaining liquid can be improved.

Further features of the present disclosure will become apparent from the following description of exemplary embodiments with reference to the attached drawings.

DESCRIPTION OF THE EMBODIMENTS

Hereinafter, a description will be given, with reference to the drawings, of embodiments (examples) of the present disclosure. However, the sizes, materials, shapes, their relative arrangements, or the like of constituents described in the embodiments may be appropriately changed according to the configurations, various conditions, or the like of apparatuses to which the disclosure is applied. Therefore, the sizes, materials, shapes, their relative arrangements, or the like of the constituents described in the embodiments do not intend to limit the scope of the disclosure to the following embodiments. Each of the embodiments of the present disclosure described below can be implemented solely or as a combination of a plurality of the embodiments or features thereof where necessary or where the combination of elements or features from individual embodiments in a single embodiment is beneficial.

First Embodiment

Figure 1A:
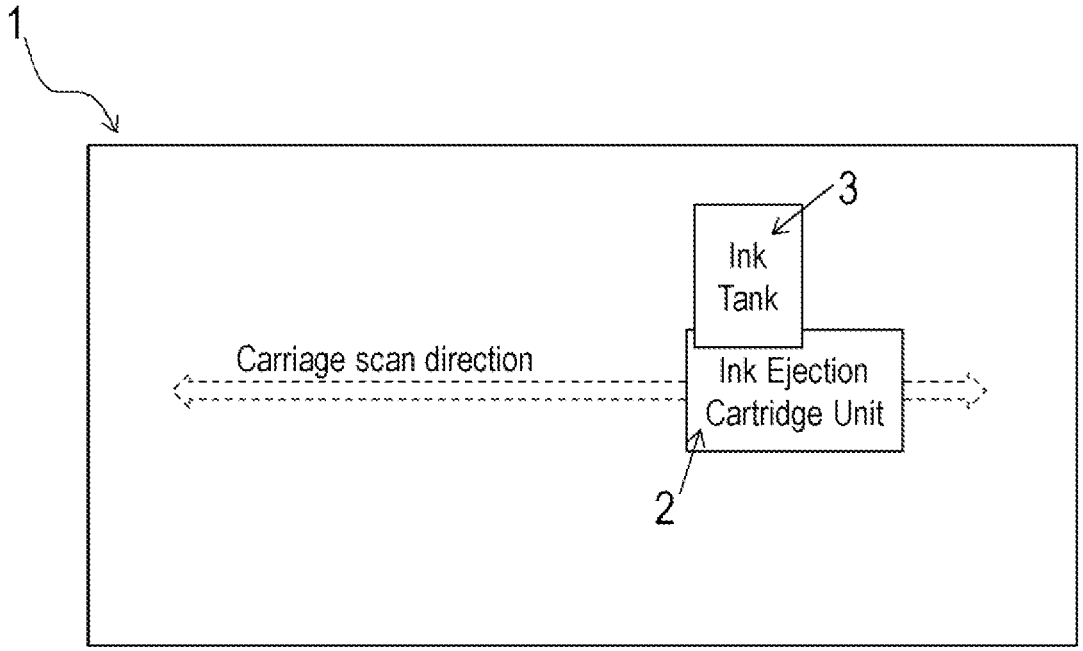
FIGS. 1A and 1B are schematic views of image recording apparatuses.
Figure 1B:
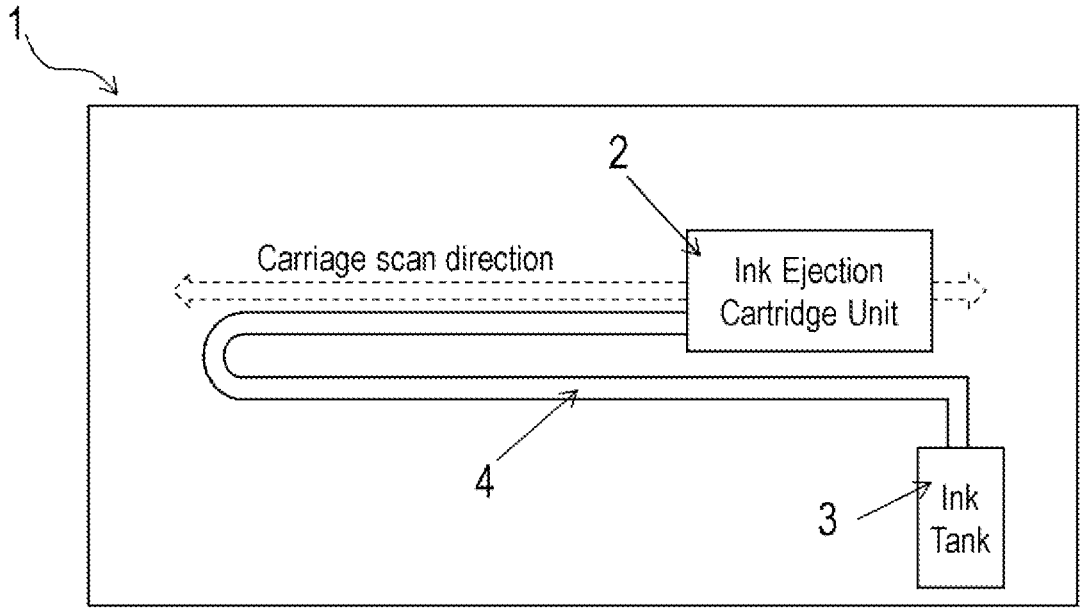

FIGS. 1A and 1B are simplified schematic views of image recording apparatuses 1 and liquid ejection cartridge units 2 according to an embodiment of the present disclosure. FIGS. 1A and 1B show different methods for supplying ink to a liquid ejection cartridge unit 2. The present disclosure may be embodied in either configuration.

FIG. 1A shows a configuration of an on-carriage ink tank method. An ink tank 3, which accommodates and stores ink as liquid to be used to record images, is directly connected to the liquid ejection cartridge unit 2 having an ink ejection function to supply ink. The ink tank 3 is configured to be detachable from the liquid ejection cartridge unit 2. In contrast, FIG. 1B shows a configuration of a tube supply method, which supplies ink as liquid (liquid supply) to the liquid ejection cartridge unit 2 from an ink tank 3 provided in the image recording apparatus through an ink supply tube 4 (liquid supply tube).

Both of the methods shown in FIGS. 1A and 1B need a detection operation when the ink supply to the liquid ejection cartridge unit 2 is interrupted. The amount of remaining ink is detected for the following two main purposes. Firstly, it is used to indicate to the user that the ink is run out in the ink tank 3 and to prompt the user to replace the ink tank 3 or refill it with ink. Secondly, it is used to detect in advance that the ejection action would continue in the absence of ink in the liquid ejection cartridge unit 2 and to trigger printing control such as printing stop or division printing so as to avoid breaking of a nozzle member, which would occur in a worst case of empty ejection. In particular, in the configuration of the tube supply method as shown in FIG. 1B, even if ink remains in the ink tank 3, air may permeate through the ink supply tube 4 and flow into the ink supply flow path after the apparatus is left for a long period of time, for example. In order to detect the empty ejection occurring in this situation, the present embodiment has a configuration for detecting the amount of ink remaining in the liquid ejection cartridge unit 2.

Figure 2A:
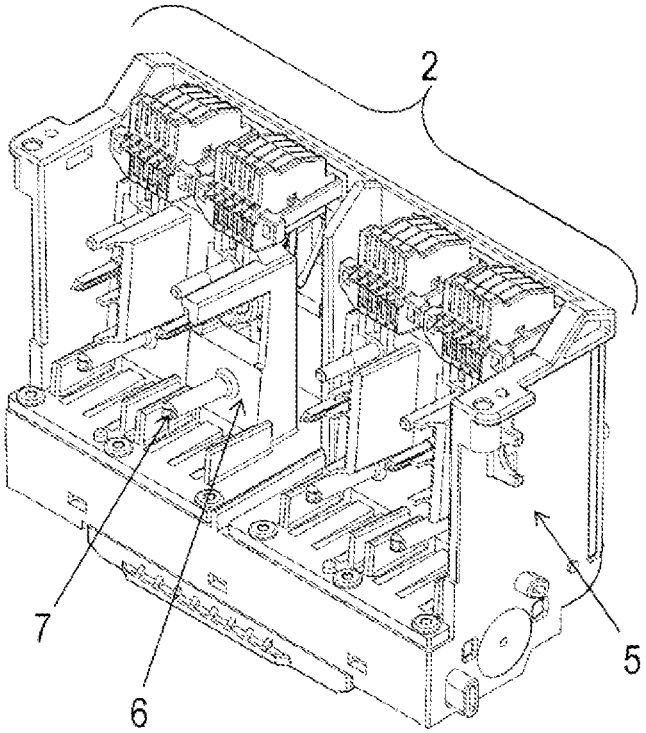
FIGS. 2A and 2B are diagrams illustrating the configuration of a liquid ejection cartridge unit.
Figure 2B:
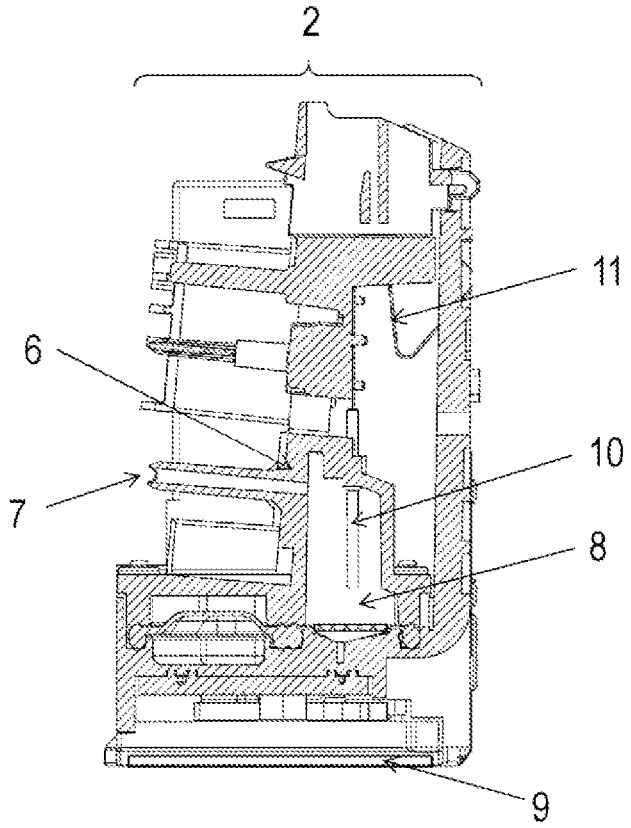

FIGS. 2A and 2B show details of the configuration of a liquid ejection cartridge unit 2 that includes therein an ink remaining amount detecting function. FIG. 2A is a diagram of the liquid ejection cartridge unit, and FIG. 2B is a lateral cross-sectional view of the liquid ejection cartridge unit. The liquid ejection cartridge unit 2 is a unit in which a head unit 5 and sub tanks 6 are combined. The ink supplied from the ink tank 3 or the ink supply tube 4 flows into the liquid ejection cartridge unit 2 through joint portions 7 of the sub tanks 6 provided independently for the respective ink colors. Each sub tank 6 has a sub-tank liquid chamber 8, and the supplied ink is temporarily held and stored in the sub-tank liquid chamber 8 and then guided to a recording element substrate 9 through an ink supply flow path formed in the housing of the head unit 5. Then, ink droplets of the ink that has passed through the ink supply flow path are ejected from the recording element substrate 9, forming an image on a recording material.

Two electrode pins 10 of a first electrode pin serving as an anode and a second electrode pin serving as a cathode are inserted into each sub-tank liquid chamber 8 to detect the presence or absence of ink in the liquid chamber. The electrode pins 10 of the present embodiment are made of SUS304 grade stainless steel in consideration of cost and workability, but other metal materials such as SUS316 grade stainless steel and SUS384 grade stainless steel may be used. The end of each inserted electrode pin 10 that is opposite to the end extending into the sub-tank liquid chamber 8 has a contact to an electrical connection member 11, through which the image recording apparatus 1 is electrically connected.

Figure 3:
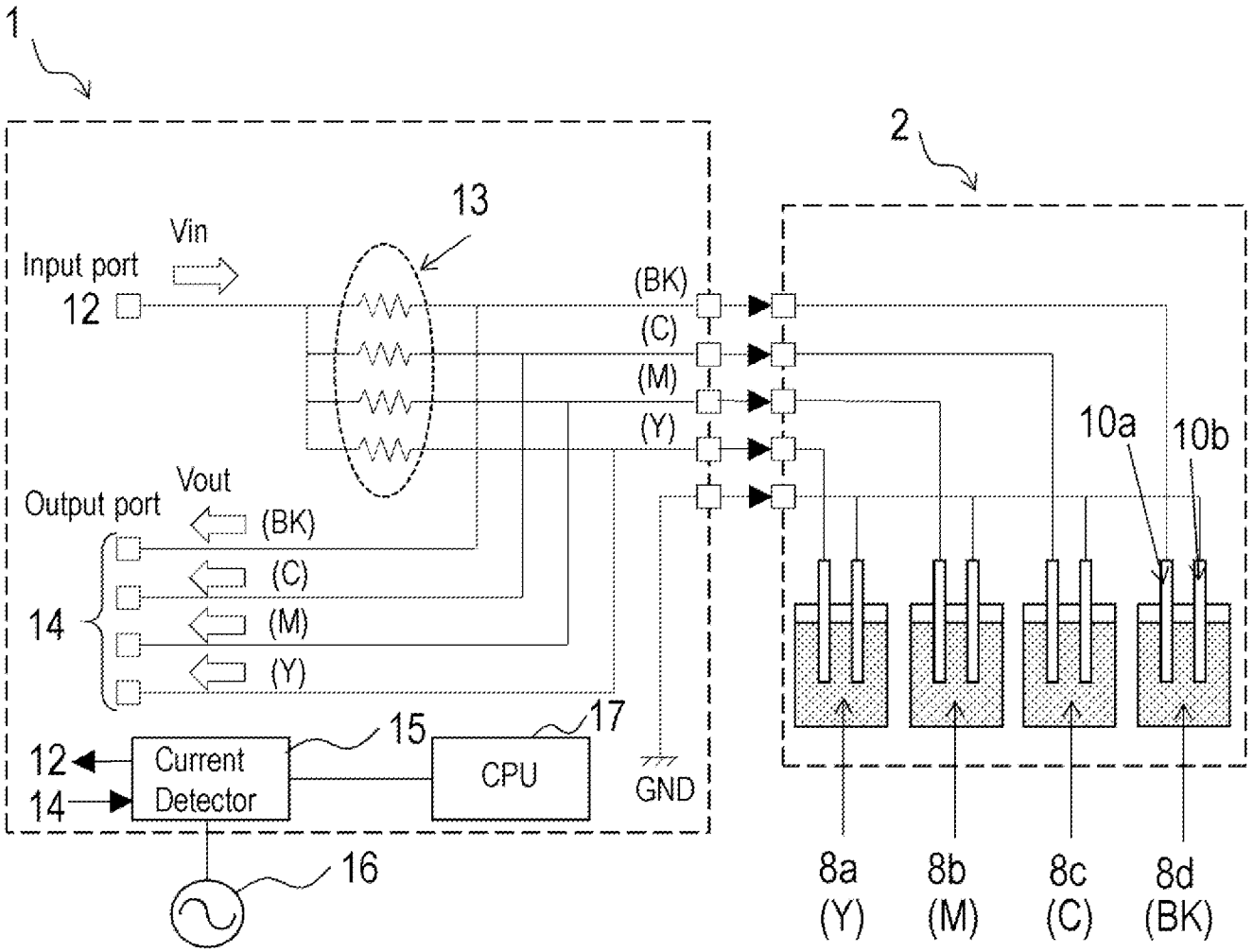
FIG. 3 is a circuit diagram of a remaining ink amount detection system.

FIG. 3 schematically shows the configuration of a system for detecting the amount of remaining ink using the electrode pins 10. A signal for detecting the remaining amount is input from an input port 12 of the image recording apparatus 1. The input signal is branched into signals that are equal in number to the inks subjected to the detection of remaining amount, and connected to the anode electrode pins 10*a* in the sub-tank liquid chambers 8 of the liquid ejection cartridge unit 2 through detection resistances 13. The cathode electrode pins 10*b* in the sub-tank liquid chambers 8 are short-circuited in the liquid ejection cartridge unit 2 and connected to the GND terminal of the image recording apparatus 1. Output ports 14 for remaining amount detection output, which are equal in number to the ink colors subjected to the detection, are connected between the detection resistances 13 and the anode electrode pins 10*a*.

In the above configuration, the voltage division ratio of the detection resistance 13 and the electrical resistance R of the ink is detected as output by a current detector 15 of the image recording apparatus 1 and sent to a control portion 17, which controls the operation of the image recording apparatus 1. The control portion 17 controls a power supply circuit that serves as a voltage application portion and uses, as the power supply source, commercial power 16 to which the image recording apparatus 1 is connected, and properly controls the magnitude and polarity of the voltage applied between the electrode pins 10*a* and 10*b* as an electric signal. The control portion 17 obtains the voltage between the electrode pins 10*a* and 10*b* from the current value detected by the current detector 15, which serves as a current detection portion and is connected to the power supply circuit, and detects the amount of ink remaining in the sub-tank liquid chamber 8 from the magnitude of the voltage. The above configuration constitutes the liquid remaining amount detection mechanism in the image recording apparatus 1 of the present embodiment.

When there is no ink in a sub-tank liquid chamber 8, the space between the anode and cathode electrode pins 10 is electrically open, so that no current flows to the liquid ejection cartridge unit 2. Thus, the voltage detected at the output port 14 is similar to the input signal. In contrast, when there is ink in the sub-tank liquid chamber 8, the anode and cathode electrode pins 10 are electrically connected via the ink, so that a current flows to the liquid ejection cartridge unit 2. Thus, the signal detected at the output port 14 has a lower voltage level than the input signal. In the embodiment of the present disclosure, the voltage value is detected and determined with respect to the input signal, but the current value may be detected and determined.

Figure 4A:
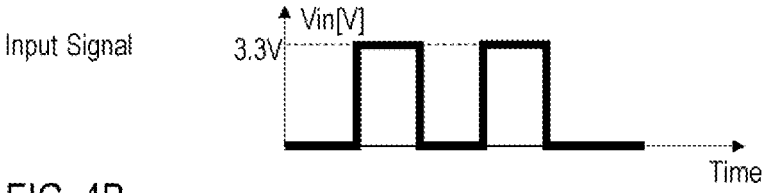
FIGS. 4A to 4D are diagrams showing examples of an input signal and output signals for remaining ink amount detection.

FIGS. 4A to 4D show the output levels in an example of a conventional detection system. In a remaining amount detection configuration that has been conventionally adopted, the remaining amount detection signal input from the input port 12 has two 3.3 V rectangular pulses as shown in FIG. 4A. At the output port 14, the output "Val(Min)" immediately before the input of the second pulse and the output "Val(Max)" immediately before the fall of the second pulse are obtained to detect a remaining amount detection output (Output Val)="Val(Max)−Val(Min)".

Figure 4B:
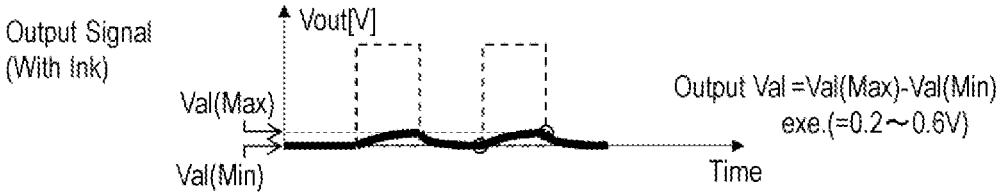
Figure 4C:
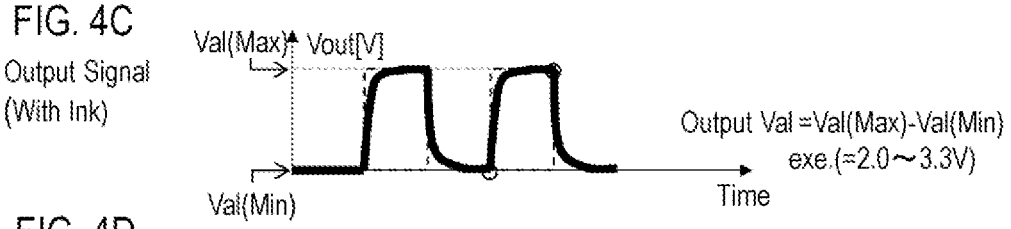

In one example, the remaining amount detection output is as low as 0.2 V to 0.6 V as shown in FIG. 4B when there is ink, and the output is about 2.0 V to 3.3 V as shown in FIG. 4C when there is no ink.

Figure 4D:
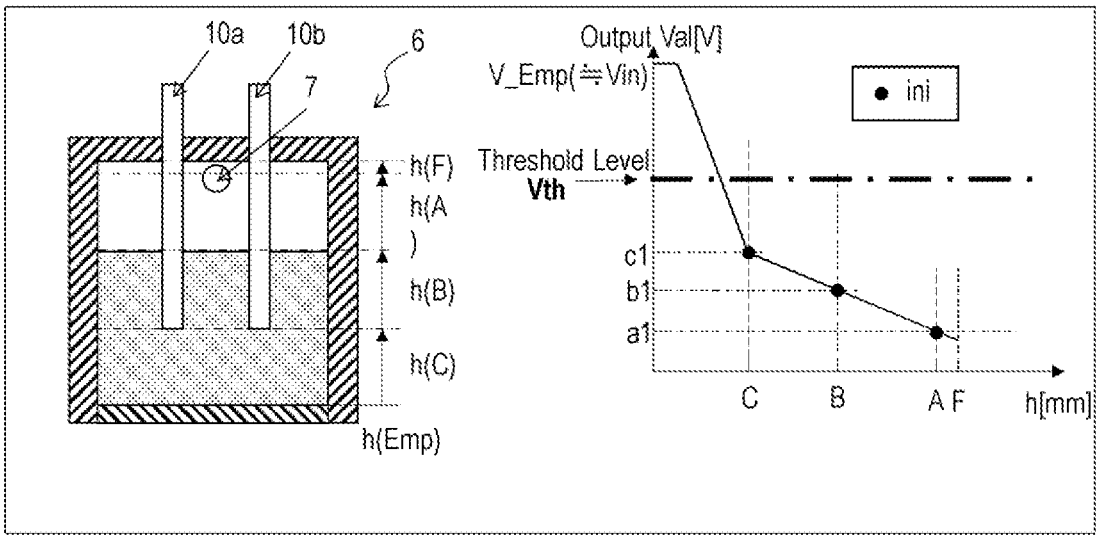

FIG. 4D illustrates the transition of the amount of ink remaining in a sub-tank liquid chamber 8 (liquid amount) and the remaining amount detection output. As the ink is consumed with the ink level still in contact with the electrode pins 10 (level h(A)→h(B)→h(C)), the remaining amount detection output changes from a1→b1→c1 with a gentle gradient. Then, when the ink level is separate from the electrode pins 10, the gradient of the output transition of the remaining amount detection output increases. When the ink level becomes separate from the electrode pins 10, the ink, bubbles, or the like that remain in the meniscus between the electrode pins 10 causes the output to transition with a high gradient, instead of in a digital manner.

To detect the amount of remaining ink, a common method is to set a determination threshold value Vth that is used to determine whether an output value between the ink levels h(C) and h(Emp), that is, an ink amount between c1 and V_Emp is lower than a predetermined amount. In this manner, the value of remaining amount detection output exceeds the determination threshold value in the period between when the ink level becomes lower than the tips of the electrode pins 10 and when the tank becomes empty. This allows for the detection of the time at which the tank should be replenished with ink.

If the output value of remaining amount detection output with respect to the amount of remaining ink is constant, it is possible to achieve accurate detection by setting the threshold value as described above. However, when a metal material such as a stainless steel material (SUS304) is used for the electrode pins 10 and the operation of passing a current in one direction between the electrode pins 10 via the ink is repeated, a metal oxidation/reduction reaction may occur on the surfaces of the electrode pins 10. The oxidation/reduction reaction is a phenomenon in which oxidation proceeds on the surface of the anode electrode pin 10*a* and reduction proceeds on the surface of the cathode electrode pin 10*b*. As the above reaction proceeds, the oxidation of the anode electrode pin 10*a* increases the electrical resistance. This reduces the value of current between the electrode pins 10 even though the ink is present, resulting in an increase in the remaining amount detection output.

Figure 5:
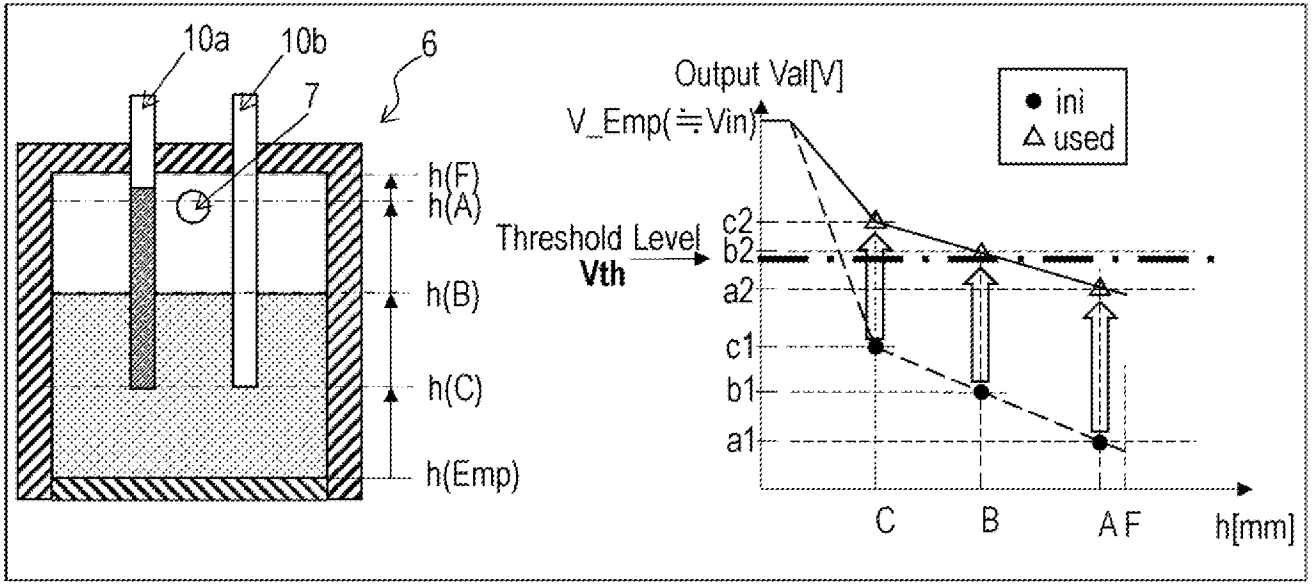
FIG. 5 is a diagram showing an example of output signals after a first electrode pin (anode side) is oxidized.

To illustrate the influence of the oxidation/reduction reaction of the electrode pins 10 on the remaining amount detection output as described above, FIG. 5 shows the shift in the output from the initial state before oxidation/reduction (ini) and the state after oxidation/reduction of the electrode pins 10 (used). In the initial (ini) state, setting the determination threshold value to a value between c1 and V_Emp, which are the remaining amount detection outputs obtained when the ink level is at the tips of the pins h(C) and when the tank is empty h(Emp), respectively, allows the detection of remaining amount to be performed with the intended remaining amount. However, when the anode electrode pin 10*a* is oxidized as the cumulative application time, which is the cumulative total of the durations during which a voltage is applied, increases, the output value of remaining amount detection output increases significantly. When the determination threshold value is set to a fixed value, the output value of remaining amount detection output may be detected as exceeding the determination threshold value earlier than the time at which ink replenishment is actually required. This phenomenon causes the output value of remaining amount detection output to be detected as exceeding the determination threshold value even though the pins are sufficiently immersed in the ink and it is not the suitable time for ink replenishment. If the output value of remaining amount detection output is detected as exceeding the determination threshold value earlier, a problem would result such as that the user is prompted to replace the ink tank 3 or that the printing speed is frequently lowered even though a sufficient amount of ink remains. The determination threshold value can be changed according to the number of pulses applied to the electrode pins 10. However, the individual differences among the electrode pins 10 result in the variations in the output shift caused by the oxidation. It is therefore difficult to obtain high detection accuracy.

Figure 6A:
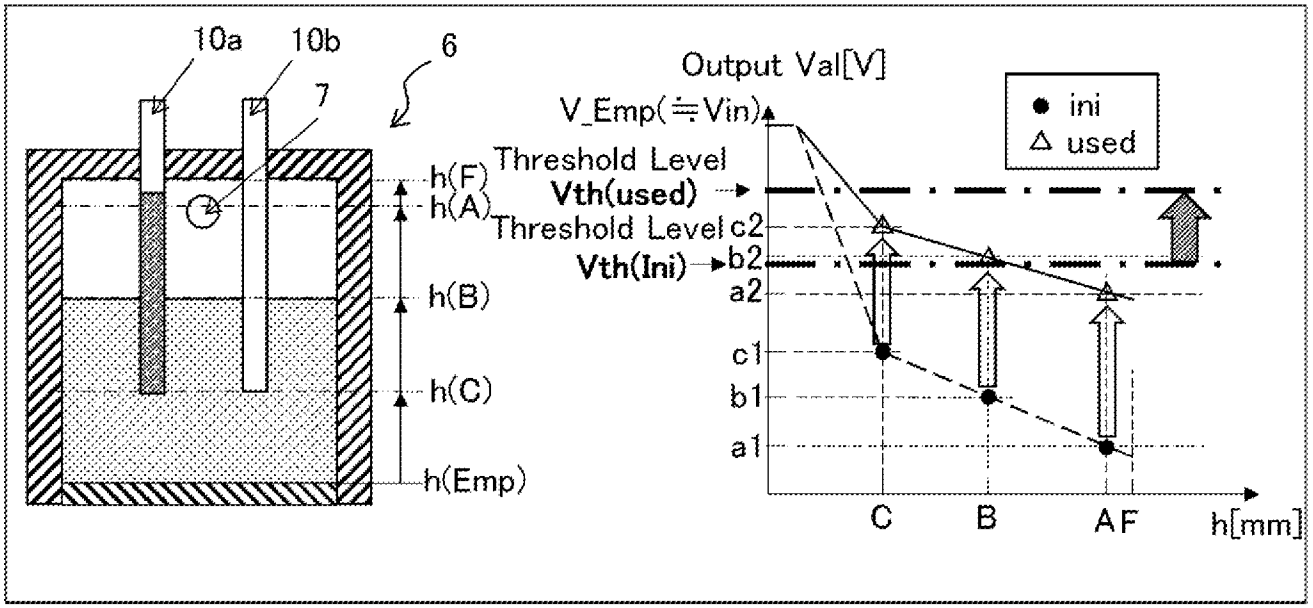
FIGS. 6A and 6B are diagrams showing the influence of electrode pin oxidation in a first embodiment.
Figure 6B:
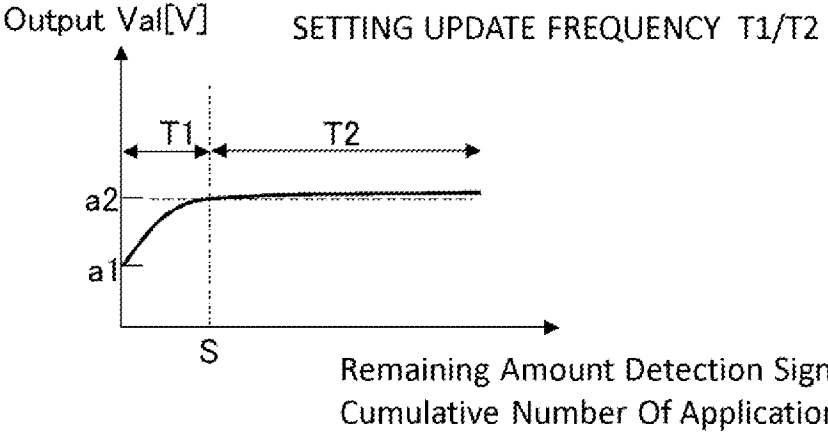

In view of the condition described above, a configuration to detect the ink remaining amount accurately after the electrode pins 10 are oxidized/reduced due to the application of pulses is now described referring to FIGS. 6A and 6B. As described above, as the oxidation/reduction of the electrode pins 10 proceeds due to the application of pulses to the electrode pins 10, the remaining amount detection output corresponding to a specific amount of remaining ink increases from "ini" to "used". If the determination threshold value for the ink remaining amount detection output is fixed to the initial value "Vth(Ini)" under this condition, the output "used" obtained after the oxidation/reduction of the electrode pins 10 will be detected as exceeding the determination threshold value "Vth(Ini)" even though a sufficient amount of ink still remains. To avoid this, the present embodiment uses a configuration that changes the determination threshold value from "Vth(Ini)"→"Vth(used)" as shown in FIG. 6A. For example, by offsetting the determination threshold value "Vth(used)" by the degree of increase in the remaining amount detection output that is estimated based on the number of applied pulses or the cumulative application time, an appropriate determination threshold value can be set according to the degree of progress of the oxidation/reduction of the electrode pins 10. That is, it is possible to perform accurate remaining amount detection in which the influence of oxidation/reduction is canceled.

Since the progress of oxidation/reduction of the electrode pins 10 differs depending on the ink type, setting the offset amount of the determination threshold value of the remaining amount detection output for each ink type further improves the detection accuracy.

Also, the remaining amount detection output may be obtained first when the liquid chamber is filled with ink (when the ink amount is a predetermined amount or more) such as the time at which the liquid ejection cartridge unit is used for the first time, or the liquid refill time at which the liquid chamber is refilled with ink. Consequently, the difference in the remaining amount detection output from the start of use can be obtained as the influence of the oxidation of the electrode pins 10 and used as the offset amount of the determination threshold value.

In this embodiment, the setting of the determination threshold value is updated at intervals of a fixed number of applications of input signals from the input port 12, or every fixed period. That is, the setting of determination threshold value is updated at intervals. Referring to FIG. 6B, the update of determination threshold value setting is now described. In FIG. 6B, the horizontal axis indicates the cumulative number of applications of remaining amount detection signals, and the vertical axis indicates the change in the remaining amount detection output caused by the oxidation of the electrode pin 10. As the cumulative number of applications increases, the cumulative application time also increases. As shown in FIG. 6B, the remaining amount detection output significantly increases in the initial T1 period (first period) after the start of voltage application and then gradually shifts to a slow change in the subsequent T2 period (second period). This is because the oxidation on the surface of the electrode pins 10 is saturated at a certain degree. Since the oxidation of the electrode pins 10 proceeds differently in the T1 period and the T2 period, it is effective to change the determination threshold value according to the cumulative number of applications. That is, the frequency of setting update that changes the determination threshold value described above may be variable such that the frequency is high in the oxidation progress period (T1) and low in the oxidation stable period (T2). For example, the determination threshold value of the remaining amount detection output may be changed by updating the setting at intervals, such as every 0.1E+05 pulses in the oxidation progress period (T1) and every 1E+05 pulses in the oxidation stable period (T2).

The ink that is subjected to the detection of remaining amount may be of various types. In consideration of factors such as image performance and material cost, the present embodiment uses, among self-dispersing pigments, an ink that uses the carboxylic acid-based self-dispersing CB (self-dispersing carbon black). With this ink, the value of remaining amount detection output tends to increase significantly when the electrode pin 10*a* is oxidized due to the application of voltage from the input port 12. In this case, the present disclosure is particularly beneficial, and the remaining amount can be accurately detected regardless of the ink type. On the other hand, since the oxidation phenomenon also occurs with other inks, the advantageous effect of improving the accuracy of remaining amount detection can also be obtained by applying the configuration of the present disclosure to other inks.

As described above, the first embodiment achieves the accurate detection of remaining ink amount even in a configuration that uses a metal material (such as grades SUS304, SUS384, or SUS316) that tends to cause an oxidation action of the electrode pins 10 or an ink that tends to cause an oxidation action.

In a configuration in which ink is supplied by the tube supply method, air may permeate through the tube after the apparatus is left for a long time, or air may be irregularly contained in the supply path. This may affect the ejection. The configuration of the present disclosure, which accurately detects the remaining ink amount, is effective at detecting such affected ejection and avoiding empty ejection.

In the present embodiment, the amount of ink remaining in the liquid ejection cartridge unit 2 is detected, but the present disclosure is also applicable to the detection of the amount of ink remaining in the ink tank 3 or other ink supply paths. In particular, the detection of the amount of ink remaining in a small space, such as the ink supply tube 4 or the sub tank 6, needs higher detection accuracy since only a limited distance can be set between the tips of the electrode pins 10 and the liquid level of the ink. That is, when the remaining amount detection output shifts due to the oxidation of the electrode pin 10, it becomes difficult to correctly determine the amount of remaining ink. As such, the present disclosure is particularly effective in this situation.

Second Embodiment

Figure 7A:
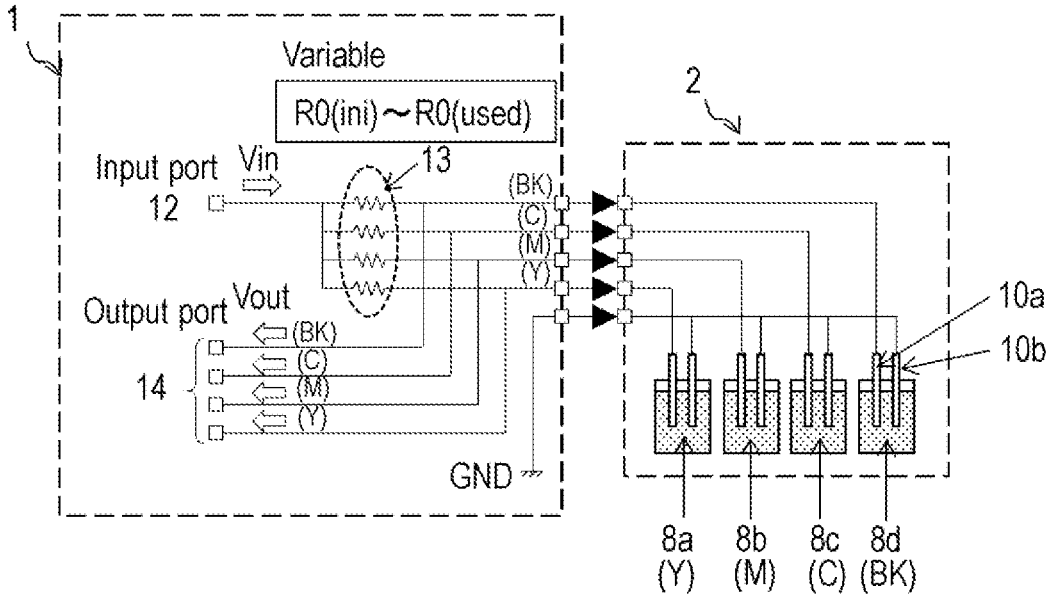
FIGS. 7A and 7B are diagrams showing the influence of electrode pin oxidation in a second embodiment.
Figure 7B:
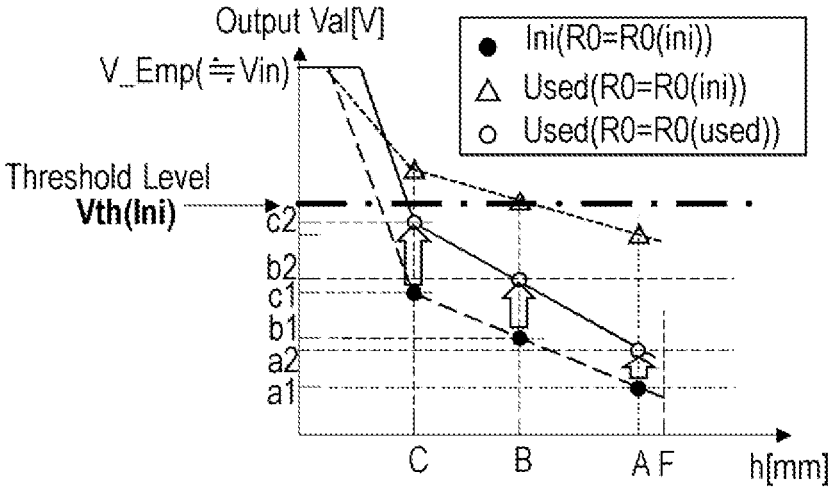

FIGS. 7A and 7B show the configuration and the remaining amount detection output of a second embodiment. Here, only the points different from those of the first embodiment are described. As in the first embodiment, the purpose of this embodiment relating to the remaining amount detection output is to accurately detect the amount of remaining ink when the application of voltage from the input port 12 causes the oxidation of the anode electrode pin 10*a*.

In this embodiment, the detection resistance value of the detection resistances 13 is changed as shown in FIGS. 7A and 7B. Since the output value Val [V] of the remaining amount detection output is detected from the voltage division ratio of the detection resistance 13 and the electrical resistance R of the ink, the remaining amount detection output corresponding to a change in the electrical resistance R of the ink can be adjusted by changing the detection resistance value of the detection resistance 13. Thus, by changing the detection resistance value of the detection resistance 13 according to the progress of oxidation of the electrode pin 10 to increase the detection sensitivity of the electrode pin 10, it is possible to reduce the influence of a change in the remaining amount detection output caused by the oxidation. For example, when the detection resistance value of the detection resistance 13 is increased according to the progress of oxidation of the electrode pin 10, the output value Val [V] of the remaining amount detection output, which corresponds to the voltage division ratio of the resistances, decreases. The output value is thus adjusted in accordance with the influence of the oxidation of the anode electrode pin 10*a*. The frequency of setting update of the detection resistance value of the detection resistance 13 may be variable also in this embodiment such that the frequency is high in the oxidation progress period (T1) and low in the oxidation stable period (T2) as shown in FIG. 6B.

Third Embodiment

Figure 8A:
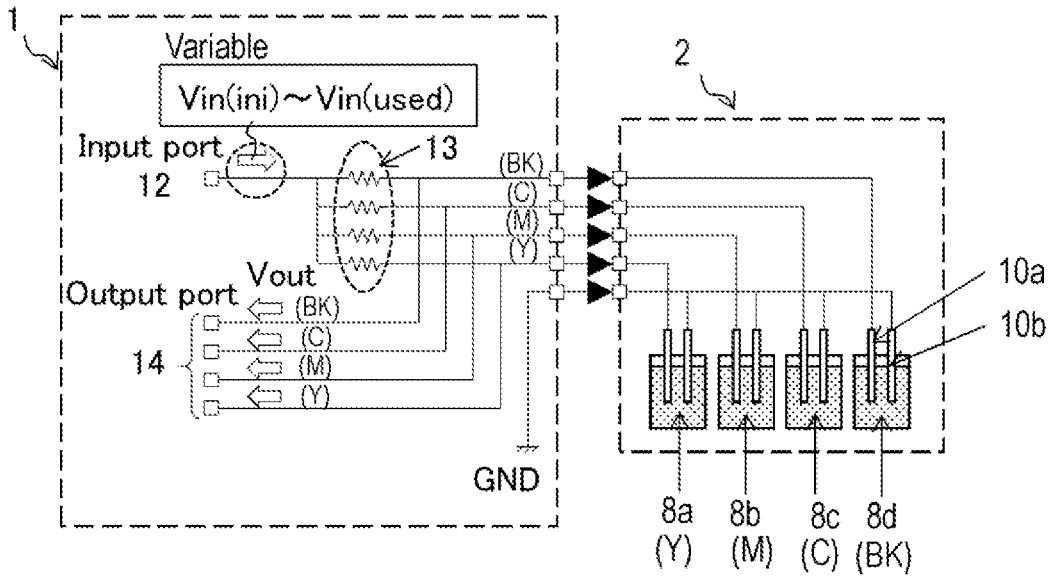
FIGS. 8A and 8B are diagrams showing the influence of electrode pin oxidation in a third embodiment.
Figure 8B:
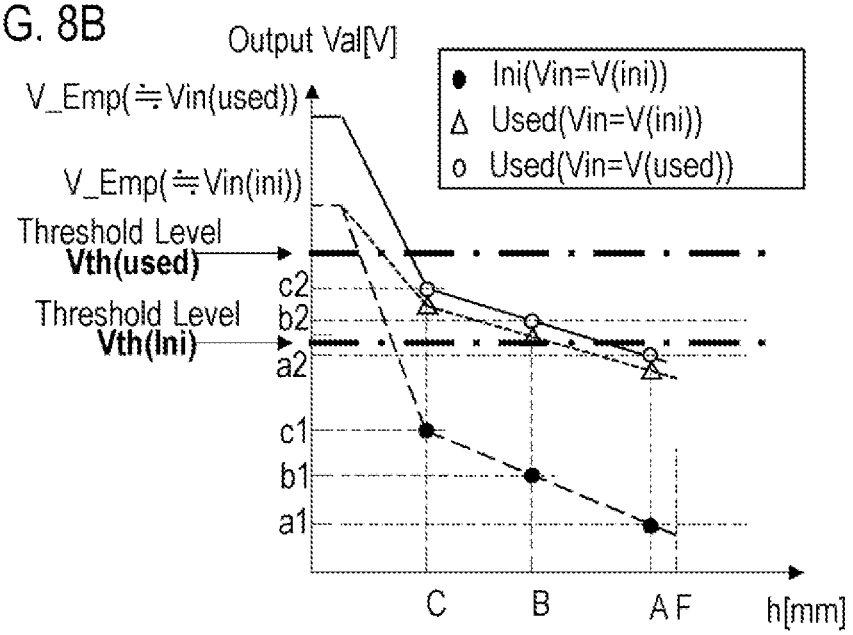

FIGS. 8A and 8B show the configuration and the remaining amount detection output of a third embodiment. The first embodiment is a configuration that changes the determination threshold value Vth according to the progress of oxidation of the electrode pin 10*a*. This configuration changes the determination threshold value Vth to reduce the false detection resulting from the shift in remaining amount detection output caused by the oxidation of the electrode pin 10. However, after the electrode pin 10 is oxidized, the difference between the output values of remaining amount detection output with and without ink becomes small, and it becomes difficult to detect whether the value of remaining amount detection output exceeds the determination threshold value Vth. In particular, when level C changes to level 0 as indicated on the horizontal axis in FIGS. 8A and 8B, the difference between the output values of remaining amount detection output is small after the electrode pin 10*a* is oxidized, making it difficult to detect whether the output value exceeds the determination threshold value Vth.

To solve this, in this embodiment, not only the determination threshold value Vth is variable, but also the applied voltage value Vin applied from the input port 12 can be changed according to the oxidation progress of the electrode pin 10 as shown in FIGS. 8A and 8B. According to this configuration, even when the remaining amount detection output increases due to the oxidation of the electrode pin 10, the difference between the output values of the remaining amount detection output with and without ink can be increased by increasing the applied voltage value Vin. The accurate detection is thus maintained even after the electrode pin 10 is oxidized. The frequency of setting update of the determination threshold value Vth and the applied voltage value Vin may be variable also in this embodiment such that the frequency is high in the oxidation progress period (T1) and low in the oxidation stable period (T2) as shown in FIG. 6B.

The present embodiment changes both the determination threshold value Vth and the applied voltage value Vin, but only the applied voltage value Vin may be changed without changing the determination threshold value Vth. This is because the detection can be accurately performed by increasing the difference between the output values of remaining amount detection output with and without ink after the electrode pin 10 is oxidized, even if the determination threshold value Vth is not changed.

Fourth Embodiment

Figure 9A:
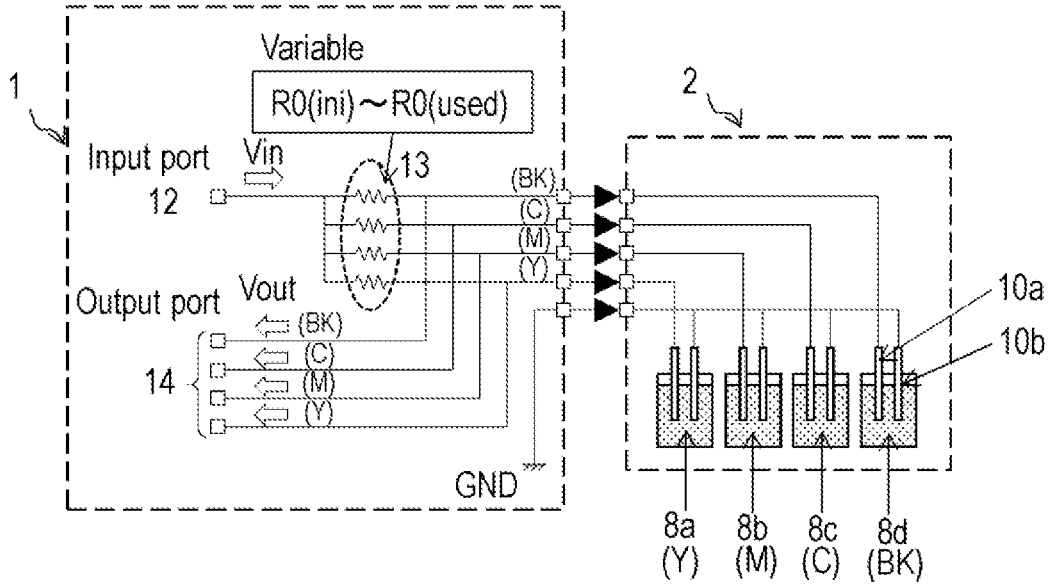
FIGS. 9A and 9B are diagrams showing the influence of electrode pin oxidation in a fourth embodiment.
Figure 9B:
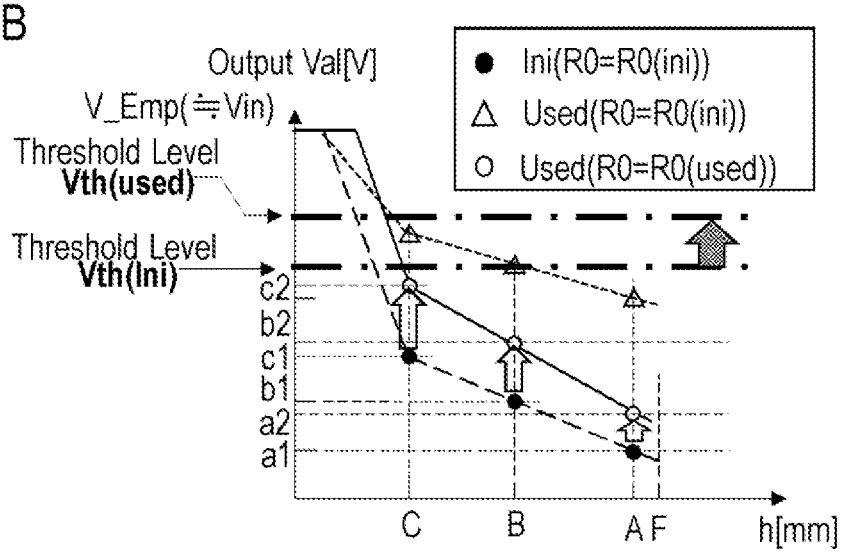

FIGS. 9A, 9B, 10A, 10B, 11A, and 11B show the configurations and the remaining amount detection outputs of a fourth embodiment. FIGS. 9A and 9B show a configuration in which not only the determination threshold value Vth is variable but also the detection resistance value of the detection resistance 13 can be changed. In this configuration, according to the oxidation state of the electrode pin 10, the detection resistance value of the detection resistance 13 is changed to adjust the value of remaining amount detection output, and also the determination threshold value Vth can be set to an appropriate value. This configuration can limit a decrease in the detection sensitivity of the electrode pin 10, thereby limiting an increase in the value of remaining amount detection output. Thus, the adjustment amount (offset amount) of the determination threshold value Vth can be reduced, and the accurate detection is maintained.

Figure 10A:
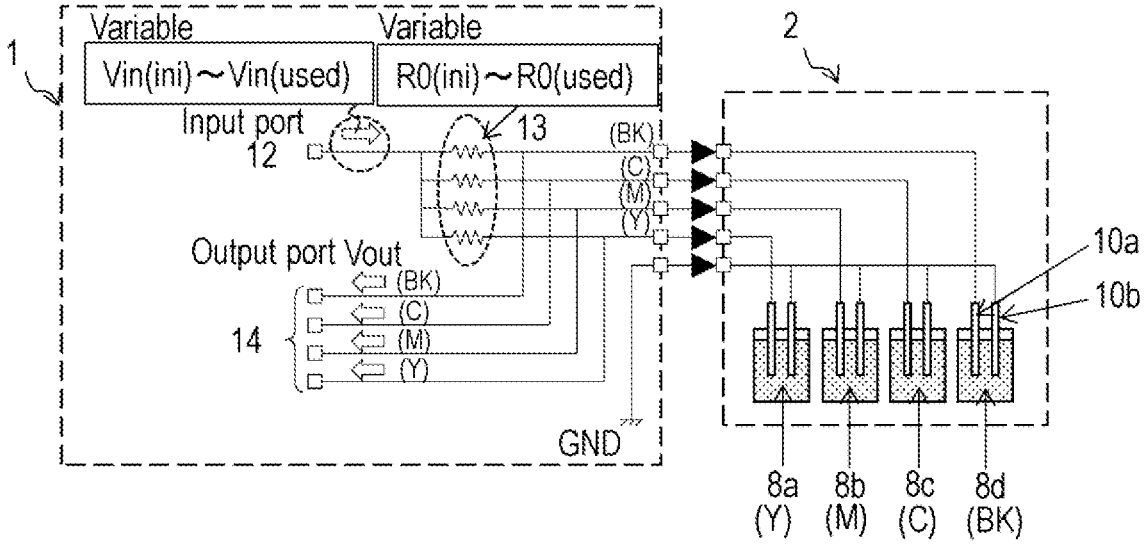
FIGS. 10A and 10B are diagrams showing the influence of electrode pin oxidation in the fourth embodiment.
Figure 10B:
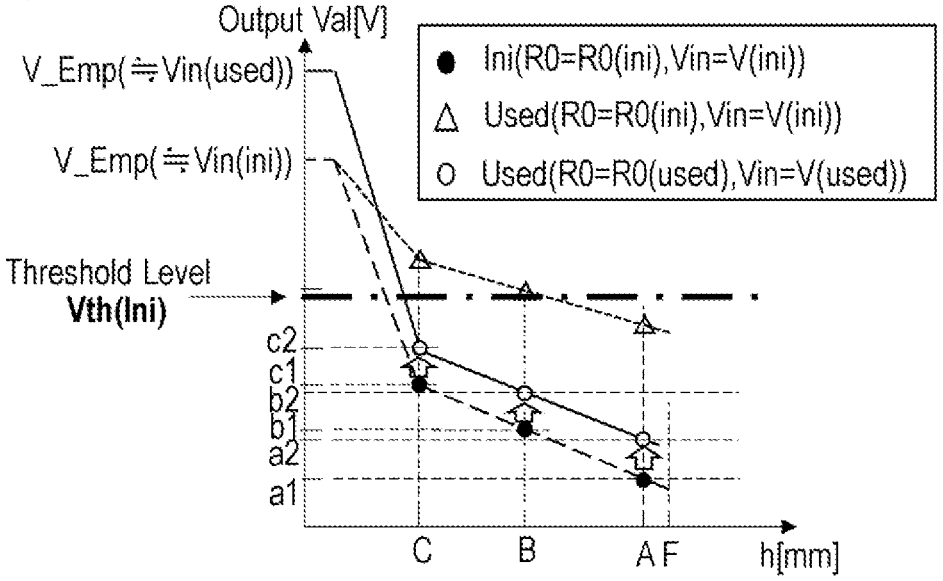

FIGS. 10A and 10B show a configuration that can change the detection resistance value of the detection resistance 13 and the applied voltage value Vin. This configuration adjusts the detection resistance value of the detection resistance 13 according to the degree of oxidation progress of the electrode pins 10, and increases the applied voltage value Vin to increase the difference between the remaining amount detection output values with and without ink after the electrode pin 10 is oxidized. As a result, the shift in the remaining amount detection output value caused by the oxidation of the electrode pin 10 is reduced, limiting an increase in the value of remaining amount detection output. In addition, the accurate detection of remaining amount detection output can be maintained in a condition under which the remaining ink amount is difficult to detect.

Figure 11A:
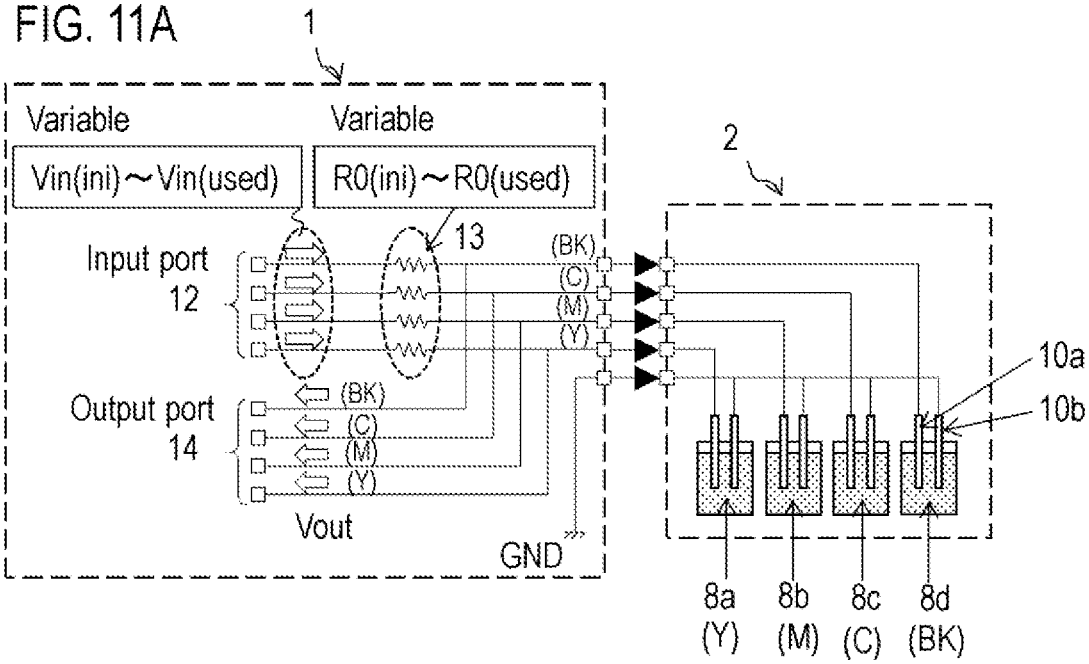
FIGS. 11A and 11B are diagrams showing the influence of electrode pin oxidation in the fourth embodiment.
Figure 11B:
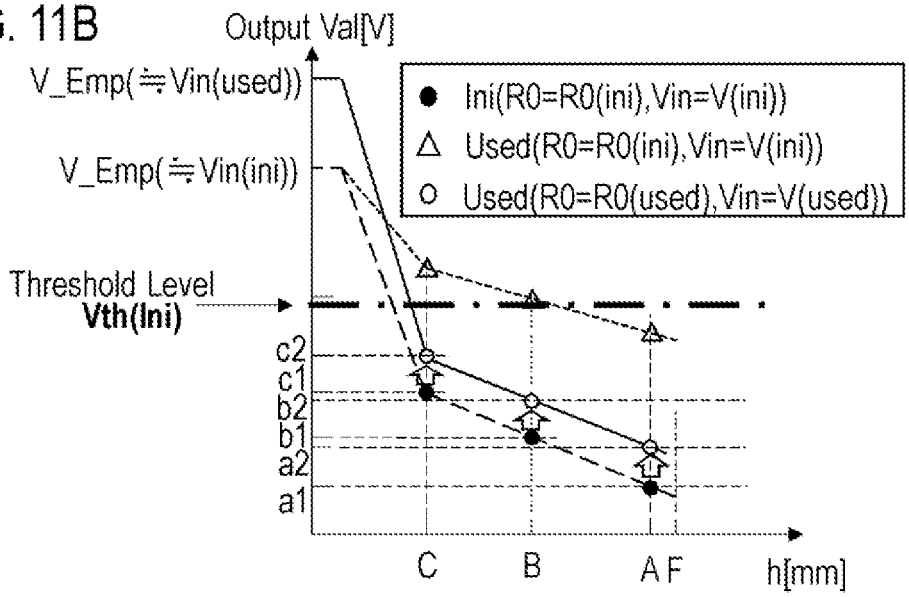

FIGS. 11A and 11B show a configuration that can change the detection resistance value of the detection resistance 13 and the applied voltage value Vin for each ink type. Different ink types have different characteristics regarding the degree of oxidation progress caused by the application of voltage to the electrode pins 10. As such, setting the applied voltage value Vin applied from the input port 12 and the detection resistance value of the detection resistance 13 separately for each ink type as shown in FIGS. 11A and 11B can achieve accurate detection regardless of the ink characteristics. The frequency of setting update of each of the determination threshold value Vth, the applied voltage value Vin, and the detection resistance value of the detection resistance 13 may be variable also in this embodiment such that the frequency is high in the oxidation progress period (T1) and low in the oxidation stable period (T2) as shown in FIG. 6B.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-027693, filed on Feb. 24, 2021, which is hereby incorporated by reference herein in its entirety.

What is claimed is:

1. An image recording apparatus comprising:

a liquid ejection cartridge unit that ejects ink droplets from a recording element substrate to form an image on a recording material, the liquid ejection cartridge unit including:

a liquid chamber that stores liquid to be used to record an image; and a first electrode pin and a second electrode pin inserted in the liquid chamber;

an application portion that applies a voltage between the first electrode pin and the second electrode pin; and a detection portion that includes a detection resistance to which a voltage is applied by the application portion, and detects a voltage value or a current value between the first electrode pin and the second electrode pin, wherein in a case the application portion applies a voltage between the first electrode pin and the second electrode pin, the detection portion detects the voltage value or the current value so that a detection action that detects an amount of the liquid remaining in the liquid chamber is performed, and at least one of a determination threshold value for determining whether the amount of the liquid in the liquid chamber is less than a predetermined amount, an applied voltage value applied by the application portion, or a detection resistance value of the detection resistance is set at intervals based on a cumulative application time of the voltage.

2. The image recording apparatus according to claim 1, wherein the determination threshold value is set at intervals such that the determination threshold value increases as the cumulative application time of the voltage increases.

3. The image recording apparatus according to claim 1, wherein the detection resistance value is set at intervals such that the detection resistance value increases as the cumulative application time of the voltage increases.

4. The image recording apparatus according to claim 1, wherein the applied voltage value is set at intervals such that the applied voltage value increases as the cumulative application time of the voltage increases.

5. The image recording apparatus according to claim 1, wherein the determination threshold value, the applied voltage value, or the detection resistance value that is initially set is set based on the voltage value or the current value that is detected by the detection portion in a state in which the amount of the liquid in the liquid chamber is greater than a predetermined amount.

6. The image recording apparatus according to claim 5, wherein the state in which the amount of the liquid in the liquid chamber is greater than the predetermined amount is a time at which the liquid ejection cartridge unit is used for a first time or a time at which the liquid chamber is refilled with liquid.

7. The image recording apparatus according to claim 1, wherein the determination threshold value, the applied voltage value, or the detection resistance value is set based on a type of the liquid.

8. The image recording apparatus according to claim 1, wherein a frequency of setting update of the determination threshold value, the applied voltage value, or the detection resistance value changes based on the cumulative application time of the voltage, the frequency is high in an initial first period from start of application of the voltage, and the frequency in a second period subsequent to the first period is lower than the frequency in the first period.

9. The image recording apparatus according to claim 1, wherein the electrode pins comprise SUS304, SUS384, or SUS316.

10. The image recording apparatus according to claim 1, further comprising:

an ink tank that stores the liquid to be used to record an image; and a liquid supply tube that supplies the liquid from the ink tank to the liquid chamber, wherein the liquid chamber is a sub tank that temporarily holds the liquid supplied from the liquid supply tube, and supplies the liquid to the recording element substrate.

11. The image recording apparatus according to claim 1, further comprising:

an ink tank that is configured to be detachable from the liquid ejection cartridge unit, and stores the liquid to be used to record an image, wherein the liquid chamber is a sub tank that temporarily holds the liquid supplied from the ink tank, and supplies the liquid to the recording element substrate.

12. The image recording apparatus according to claim 1, wherein the liquid in the liquid chamber is self-dispersing carbon black.

* * * * *